US006561493B1

(12) United States Patent
Lackey, Jr.

(10) Patent No.: US 6,561,493 B1
(45) Date of Patent: May 13, 2003

(54) ADJUSTABLE GATE STRUCTURE

(76) Inventor: Joe Lackey, Jr., 323 Smith Rd., Nunnelly, TN (US) 37137

( * ) Notice: Subject to any disclaimer, the term of this patent is extended or adjusted under 35 U.S.C. 154(b) by 0 days.

(21) Appl. No.: 09/692,486

(22) Filed: Oct. 19, 2000

(51) Int. Cl.[7] ..... E06B 11/00
(52) U.S. Cl. ..... 256/73; 256/65.01
(58) Field of Search ..... 256/73, 59, 67, 256/65.01, 24, 25, 26, 21, 22, 1; 49/236, 240, 381, 389

(56) References Cited

U.S. PATENT DOCUMENTS

| | | | | | |
|---|---|---|---|---|---|
| 2,795,063 | A | * | 6/1957 | Butler | 256/24 |
| 3,290,014 | A | | 12/1966 | Stapleton | 256/73 |
| 5,716,041 | A | | 2/1998 | Groves | 256/73 |
| 5,868,382 | A | * | 2/1999 | Groves | 256/73 |
| 5,913,508 | A | * | 6/1999 | Eades | 256/65 |
| 6,036,176 | A | * | 3/2000 | Rotshtain | 256/59 |

FOREIGN PATENT DOCUMENTS

| | | | | |
|---|---|---|---|---|
| GB | 883081 | * | 11/1961 | 256/73 |
| GB | 2173527 | * | 10/1986 | 256/67 |

* cited by examiner

*Primary Examiner*—Lynne H. Browne
*Assistant Examiner*—John R. Cottingham

(57) ABSTRACT

An improved adjustable gate structure which is suitable for a fence with an opening therein which is too wide or narrow for a conventional gate, the gate's horizontal width can be increased or reduced by simple mechanical adjustments. The preferred embodiment of this gate consists of a main frame with a plurality of long horizontal panels of equal length affixed parallelographically to a vertical panel approximately 5' in height and an extension frame with the same plurality of short horizontal panels of equal length also affixed to a panel approximately 5' tall. All of the panels are spaced equally in relation to the ground. Apertures are punched or drilled equidistantly in the short panels and the distal ends of the long panels. The method to join the two frames at a pre-determined width is to interpose the short panels upon the distal ends of the long panels, thereby aligning the apertures with one or two apertures being secured on every set of panels with fasteners. Thus, the newly expanded or reduced width gate is made ready to be swingably upon its mounting post.

7 Claims, 3 Drawing Sheets

ADJUSTABLE GATE STRUCTURE

FIELD OF THE INVENTION

This invention relates to a gate whose horizontal width can be mechanically varied to properly fit the opening between two terminal fence posts.

BACKGROUND OF THE INVENTION AND DISCUSSION OF PRIOR ART

In many instances, the exact width of a gate opening in a fence is not readily attainable before the fence is constructed. This leaves the fence builder with the option of waiting to install a gate until a custom or standard manufactured gate can be obtained, or trying to fit a gate into the opening.

Several types of adjustable gates have been proposed, i.e. U.S. Pat. No. 3,290,014 to Stapleton (1966) and U.S. Pat. No. 5,716,041 to Groves (1998). These gates require complex construction and are not unlimited in extending their horizontal widths in conventional ranch type fence construction.

SUMMARY OF THE INVENTION OBJECTS AND ADVANTAGES

The adjustable gate of this invention is suitable for use with a fence, or other fixed structure. It employees five horizontal panels or slats which are attached by rivets to 3 vertical members to form the gate frame. Panels extending from right to left have distal ends protruding a chosen distance beyond the center vertical member and contain a chosen number of equidistant apertures. Five shorter panels, whose lengths are approximately equal to the lengths of the longer panels' distance beyond the center vertical panel, are mounted horizontally to the left most vertical panel and contain the same number of equidistant apertures as found in the aforementioned long panels. Therefore, by positioning the short panels against the long panels at a chosen distance with the appropriate apertures aligned, the panels can be made fast against each other secured by a series of bolts, washers and nuts. Thus, the width of the gate can be changed horizontally over the space of a few feet.

It is an object of this invention to provide an adjustable gate which is adjustable over a set horizontal width which is straight-forward and easy to assemble.

Another object of the invention is to provide a design which is relatively simple to manufacture.

Yet another object of the invention is to produce a gate which is sturdy, yet relatively light-weight and affords ease in handling.

Further objects and advantages of my invention will become apparent from a consideration of the drawings and ensuing description.

LIST OF PARTS

Figure 1:
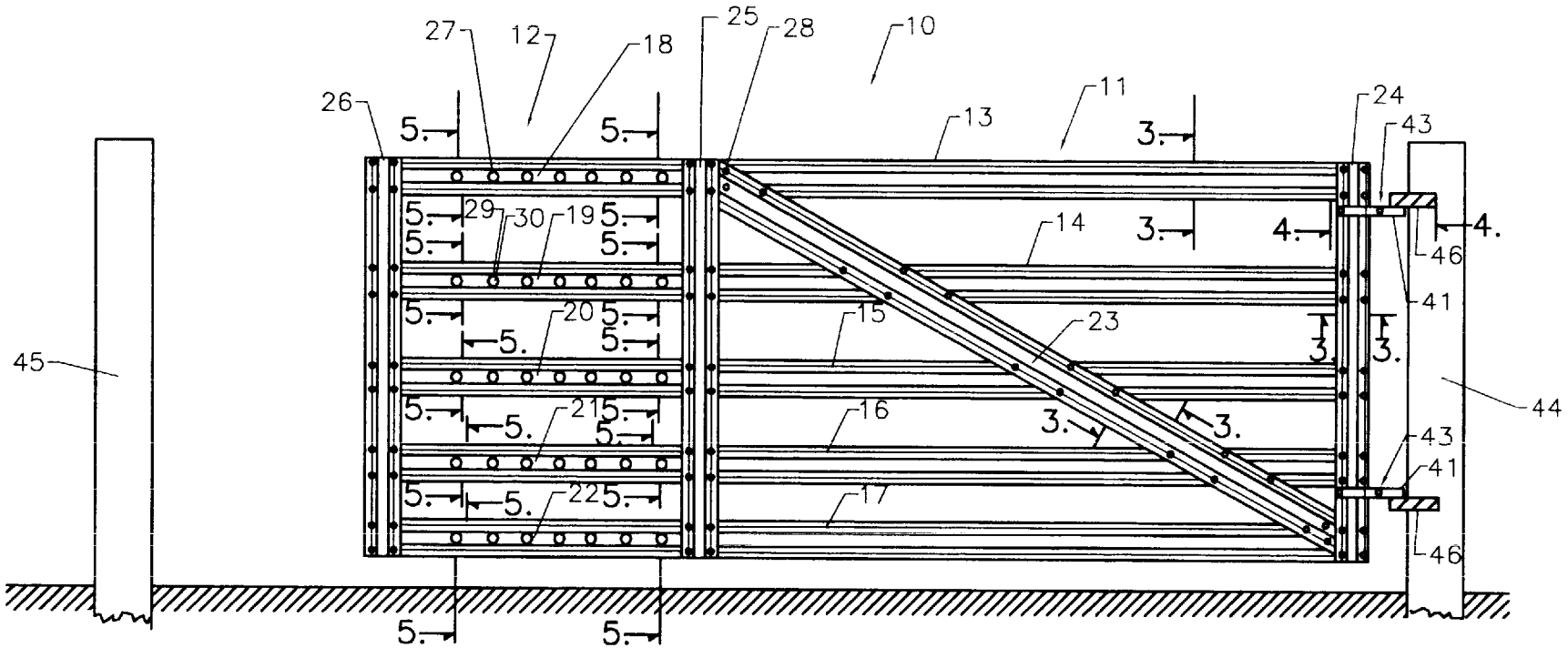
FIG. 1 depicts the adjustable gate of the invention in an environmental setting shown in mounted position between a pair of over-spaced posts.

Part No. Description
10 Gate
11 Gate frame
12 Adjustable extension unit
13 Long horizontal panel
14 Long horizontal panel
15 Long horizontal panel
16 Long horizontal panel
17 Long horizontal panel
18 Short horizontal panel
19 Short horizontal panel
20 Short horizontal panel
21 Short horizontal panel
22 Short horizontal panel
23 Angle brace panel
24 Vertical mounting panel
25 Vertical mounting panel
26 Vertical mounting panel
27 Apertures
28 Rivets
29 Washer
30 Bolt
31 Panel base portion
32 Panel inner straight portion
33 Panel outer straight portion
34 Panel flange reversely rolled
35 Wing nut
36 Bolt
37 Washer
38 Nut
39 Hinge bracket
40 Hinge bracket
41 Hinge post
42 Upstanding spindle
43 Hinge assembly socket
44 Fence post
45 Fence post
46 L-shaped holder

DETAILED DESCRIPTION OF THE PREFERRED EMBODIMENTS

Referring initially to the drawings, the gate apparatus of this invention is indicated generally at 10 in FIG. 1 and is shown in assembled mounted position between a pair of stationary fence posts—44 and 45.

The gate apparatus 10 comprises basically a frame unit 11 and a longitudinally adjustable extension unit 12. Gate 10 encompasses the preferred embodiments of this invention.

Figure 2:
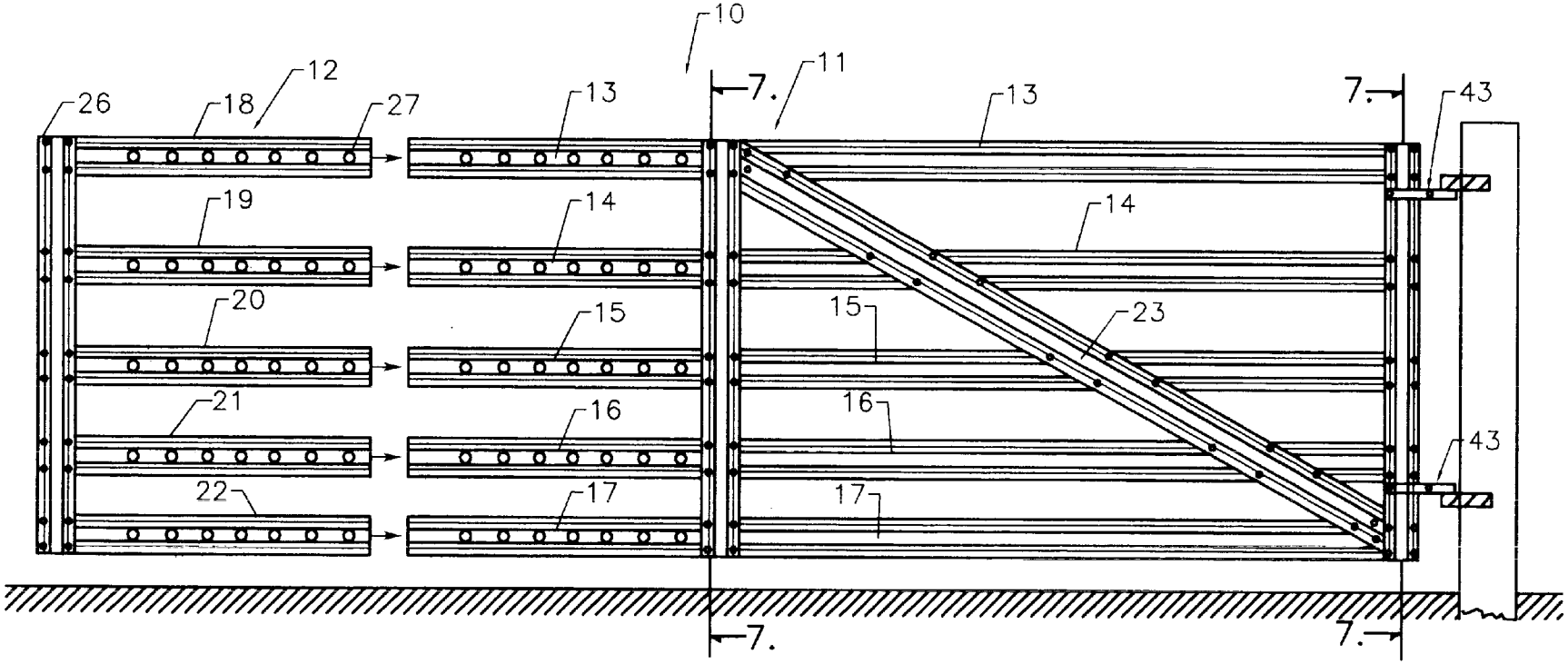
FIG. 2 is an unassembled view of the framework of the adjustable gate of FIG. 1.
Figure 7:
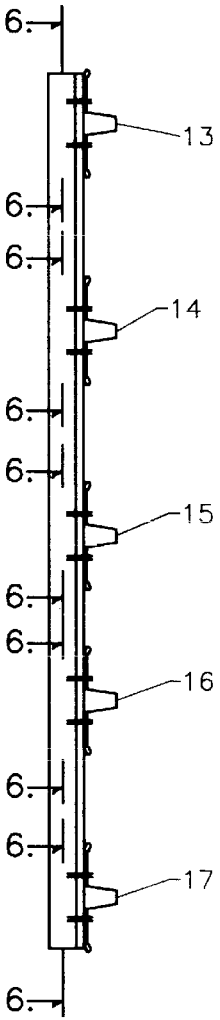
FIG. 7 is a view taken along the line 7—7 in FIG. 2.
Figure 6:
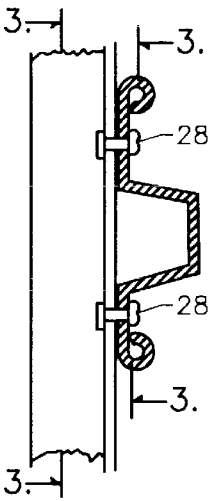
FIG. 6 is an enlarged cross-sectional view taken along the line 6—6 in FIG. 7.

The frame unit 11 includes a plurality, five in this structure, of elongated horizontal panels or slats 13, 14, 15, 16, and 17 arranged as best illustrated in FIG. 1 and FIG. 2 in a parallel manner, with the vertical spacing there between gradually lessening toward the ground. The frame unit 11 further includes a plurality, two in this instance, of upright panels 24 and 25. All panels employ rivets as fasteners 28, FIG. 6, represented as. On the drawings. FIG. 7 illustrates how the vertical and horizontal panels are riveted together. It will be noted that the upper and lower horizontal panels 13 and 17 form a rectangular outline with the inner and outer upright panels 25 and 24.

Figure 5:
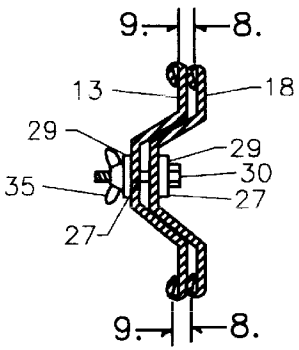
FIG. 5 is an enlarged cross-sectional view taken along the line 5—5 in FIG. 1.

Additionally, the adjustable extension frame unit 12 includes a plurality, five in this structure, of short horizontal panels 18, 19, 20, 21 and 22 arranged as shown in FIG. 2 in a parallel manner, with the vertical spacing there between gradually lessening toward the ground. The frame unit 12 also includes one upright outer panel 26 to which panels 18, 19, 20, 21 and 22 are fastened at their left distal ends and spaced exactly as panels 13, 14, 15, 16 and 17. This is essential so that when panels 18, 19, 20, 21 and 22 are interposed upon the relative panels 13, 14, 15, 16 and 17 of the adjustable extension unit 12 there will be snug fits as shown in FIG. 5.

As shown in FIG. 1 and FIG. 2, ½" diameter apertures 27 (all apertures 27 are shown as o on the drawings) are punched in plurality at equidistant pre-determined spacings specified by the builder. The apertures 27 are slightly oversized when the ⅜" bolt 30, washers 29 and wingnut 35 assemblies are used to fasten chosen pairs of apertures 27 on the panels 13, 14, 15, 16, 17 and 18, 19, 20, 21 and 22; this provides some slack in aligning the apertures. This is best illustrated in FIG. 5.

Figure 3:
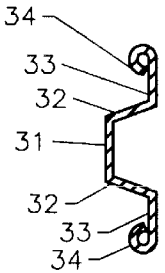
FIG. 3 is an enlarged cross-sectional view taken along the line 3—3 in FIG. 1, FIG. 4, FIG. 6, FIG. 8 and FIG. 9.

The lengths of all of panels 13, 14, 15, 16 and 17 are identical, as are the lengths of panels 18, 19, 20, 21 and 22. The lengths of the vertical panels 24, 25 and 26 are identical. Furthermore, the cross-section of all horizontal and vertical panels is identical as illustrated in FIG. 3. Referring to FIG. 1, it will be seen that FIG. 3 is taken across both a horizontal panel 13, and an upright panel 24. Each panel comprises in cross-section a straight base portion 31 (FIG. 3), a pair of straight inner portions 32 diverging from the ends of the base portion 31 at equal angles, a pair of straight side portions 33 parallel to the base portion 31 and lying within the same plane and diverging relative to each adjacent inner portion 32 at the same angle relative to the parallel base 31 and inner 32 portions. At the outer end of each straight side portion 33, a flange 34 is reversely rolled relative to the side portion 33. The material for the panels is preferred as being #24 to #18 gauge galvanized steel. The panels also can be constructed from aluminum or plastic.

Referring to FIG. 1, a panel 23 is mounted angularly to assure a rigid parallelographic form to the frame 11. Panel 23 is materially identical to all of the other panels and FIG. 3 is taken across it.

As the connection between each end of the adjustable extension unit 12 and the frame unit 11 is the same, only one will be described. Panel 18 is placed upon panel 13 in an overlapped position whereby two sets of apertures 27 on panel 18 coincide with corresponding apertures 27 on panel 13. Each pair of apertures 27 should be spaced as far apart as possible to maintain rigidity while allowing the adjustable extension unit 12 to be extended or reduced to its desired feet or inches. As best illustrated in FIG. 5, the interposed panels 18 and 13 are secured through each set of apertures 27 by a ⅜" bolt 30 and washer 29 on panel 18 shown in FIG. 8. Shown in FIG. 9, washer 29 and wing nut 35 tighten the bolt 30 after it passes through panel 13. Stainless steel bolts, washers and wing nuts are recommended for durability. In this manner, when all five pair of the panels are connected one can expand or reduce the horizontal width of gate 10.

To swingably attach the frame unit 11 to the post 44 illustrated on the right side of FIGS. 1 and 2, a pair of hinge bracket assemblies illustrated generally at 43 in FIGS. 1 and 2 are provided. Each hinge bracket 43 includes plates 39 and 40 as side support members. These plates are fastened to the locations shown in FIGS. 1 and 2 (onto panel 24) by two bolts 36, two washers 37 and two nuts 38. Plates 39 and 40 are welded to a swivel socket 41 at their distal ends. When so assembled, each hinge bracket 43 is placeable by means of its socket 41 upon the upstanding spindle 42 (FIG. 1) of an L-shaped holder 46 inserted into the post 44. The gate 10 is typically chained or tied to post 45.

OPERATION—MAIN EMBODIMENT

The gate's main frame unit 11 is held in an upright position. The adjustable extension unit 12 is placed against frame unit 11 at the desired spacing of the apertures 27 in an overlapped position. Panels 18, 19, 20, 21 and 22 are placed in interposed positions upon panels 13, 14, 15, 16 and 17 respectively.

Two pair of apertures 27 opposing each other on each set of interposed panels should coincide evenly. Each chosen pair of apertures 27 should be spaced as far apart as possible to maintain rigidity of the extension unit 12.

Figure 8:
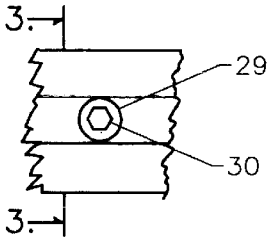
FIG. 8 is an enlarged sectional view taken along the line 8—8 in FIG. 5.
Figure 9:
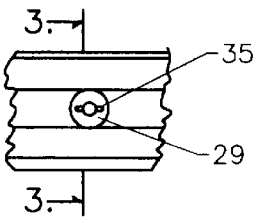
FIG. 9 is an enlarged sectional view taken along the line 9—9 in FIG. 5.

As best illustrated in FIG. 5, the interposed panels 18 and 13 (as well as 19–14, 20–15, 21–16 and 22–17) are secured through each set of selected apertures 27 by a ⅜" bolt 30 and washer 29 shown in FIG. 8. As shown in FIG. 9, washer 29 and wing nut 35 tighten the bolt 30 after it passes through aperture 27. In this manner, when all five pair of the panels are interposably connected one can expand or reduce the horizontal width of gate 10.

ALTERNATIVE EMBODIMENTS

Referring initially to the drawings, the gate apparatus of this invention is indicated generally at 50 in FIG. 1A and is shown in an assembled mounted position between a pair of statiopnary fence posts—114 and 116.

The gate apparatus 50 comprises basically a frame unit 52 and a longitudinally telescopically adjustable extension frame unit 54. Gate 50 encompasses the preferred embodiments of this invention.

The frame unit 52 includes a plurality, six in this structure, of elongated horizontal tubes or pipes 55, 56, 58, 60, 62 and 64 arranged as best illustrated in FIG. 1A in a parallelographic manner, with the vertical spacing there between being equal. All six tubes are of equal length. The frame unit 52 further includes a plurality, two in this instance, of upright equal length tubes 66 and 68.

Additionally, the adjustable extension frame unit 54 includes a plurality, six in this structure, of short equal length horizontal tubes 72, 74, 76, 78, 80 and 82 arranged as shown in FIG. 2A in a parallel manner connected to a vertical left side tube 70 of equal length to tubes 66 and 68 and equal center-to-center distances apart. The center-to-center distances must coincide with those of tubes 55, 56, 58, 60, 62 and 64 so that they will be slidable upon the latter.

The cross section 92 of the smaller inside tubes 55, 56, 58, 60, 62 and 64 is aluminum or galvanized steel with approximately a 3/16" wall and 1¾" outside diameter. It is illustrated in FIGS. 3A and 2A.

Figure 4:
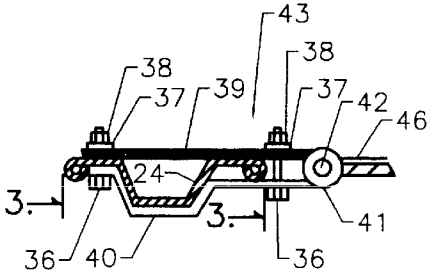
FIG. 4 is an enlarged cross-sectional view taken along the line 4—4 in FIG. 1.

The cross section 94 of the larger outside tubes 72, 74, 76, 78, 80 and 82 is aluminum or galvanized steel with approximately a 3/16" wall and a 2" inside diameter for ease of slideability. It is best illustrated in FIGS. 4A and 2A.

All tubes employ welding to fasten them together (if plastic tubes are used, they can be bolted together); as illustrated on tube 66 in FIG. 1A, tubes 55, 56, 58, 60, 62 and 64 are flattened on their distal ends and welded 86 on three sides to vertical tube 66, as illustrated on tube 68 in FIG. 9A, tubes 55, 56, 58, 60, 62 and 64 are flattened and welded 90 on four sides to the center vertical tube 68; as best illustrated on tube 70 in FIG. 8A, tubes 72, 74, 76, 78, 80 and 82 are flattened and welded 88 on three sides.

As shown in FIG. 1A and FIG. 2A, ½" apertures 84 (all apertures 84 are shown on the drawings as o) are drilled in plurality at equidistant pre-determined spacings specified by the builder. The apertures 84 are slightly over-sized when the ⅜" bolt 96, washers 98 and wing-nut 100 assemblies, along with tubes 92 and 94, are used to fasten chosen pairs of apertures in the tubes 72, 74, 76, 78, 80 and 82 slidable upon tubes 55, 56, 58, 60, 62 and 64 respectively. This provides some slack in aligning the apertures. This is illustrated in FIG. 5A.

As the connection between each distal end of the adjustable extension unit 54's tubes and those of the gate frame 52 is the same, only one will be described. Tube 72 is slipped upon tube 55 in a chosen over-lapped position whereby two sets of apertures 84 on tube 72 coincide with corresponding apertures 84 in tube 55. Each pair of apertures 84 should be as far apart as possible to maintain rigidity while still allowing the adjustable extension unit 54 to be extended or reduced to its desired inches or feet. As best illustrated in FIG. 5A, the chosen alignment of tubes 72 and 55 are secured through each set of apertures 84 by a ⅜" bolt 96, two ⅜" washers 98 and a ⅜" wing-nut 100. Tighten the sub-assemblies after they pass through tubes 92 and 94. In this manner, when all six pair of the tubes 72, 74, 76, 78, 80, 82 and 55, 56, 58, 60, 62, 64 respectively are connected, one can expand or reduce the horizontal width of the gate 50. For durability, stainless steel bolts, washers and nuts are recommended.

FIG. 6A is a sectional top view of the gate assembly taken along the line 6A—6A in FIG. 1A.

FIG. 7A is a sectional view of the bottom of the gate assembly taken along the line 7A—7A in FIG. 1A.

To swingably attach the frame unit 52 to the right mounting post 114 opposite the left stationary post 116 illustrated in FIG. 1A, a pair of hinge bracket assemblies illustrated generally at 101 in FIG. 10A are provided. Each hinge bracket 101 includes plates 102 and 104 as side support members shown in FIG. 1A. These plates are fastened to the locations shown in FIGS. 1A and 10A around tube 66 by bolt 106, washers 108 and nut 110. This forms socket 111 when so assembled and is placeable by means of each socket 111 upon the upstanding spindles of L-shaped holders inserted into the post 114. The gate 50 is typically chained or tied to post 116.

Thus, a gate structure has been disclosed which is adjustable outwardly and inwardly on a horizontal plane. The adjustable gate provides for easy installation of a gate regardless of the typical gate opening in a fence. Although a preferred embodiment of the adjustable gate, and a variation thereof, have been disclosed, it should be appreciated that further variations and modifications may he made thereto without departing from the scope of the invention as defined in the appended claims.

I claim:

1. A swingably gate which is horizontally expandable or contractable for use as a barrier in a fence, said fence has an opening therein, said opening has a gate-support post on either side thereof, comprising:

(a) a pair of vertical panels, each one riveted to opposite ends of a plurality of long and short panels, the one end is swingably attached to the one end said gate-support post;

(b) a plurality of long horizontal panels of equal length riveted, in a parallelographic manner with predetermined spacings, to the vertical panel swingably attached to the one of the gate post and a center oriented vertical panel of equal length, said horizontal panels' ends distant from the swingably attached vertical panel extending a predetermined distance beyond said center vertical panel;

(c) a plurality of short horizontal panels of predetermined equal length riveted, in a parallelographic manner, to the vertical panel end opposite the swingably attached vertical panel, vertical spacings between said short horizontal panels must coincide exactly with vertical spacings between said long horizontal panels so that when all corresponding said panels are interposed they will fit together precisely;

(d) a cross-brace is diagonally riveted to said long horizontal panels running from top of said center vertical panel to the bottom of said swingably attached vertical panel.

2. The gate in claim 1 further includes apertures about ½" in diameter punched at predetermined locations in said short horizontal panels and in precise juxtapositions to distal ends of said long horizontal panels so that when said short and long horizontal panels are interposed the said apertures will match precisely.

3. The gate in claim 2 wherein said gate's horizontal width can be extended or contracted seversal inches or feet, as predetermined, by the positions of equidistant of said apertures.

4. The gate in claim 2 wherein is assembled, secured in a rigid fashion and adjusted by use of fasteners, each comprised of one bolt approximately ⅜" in diameter, two compatable washers and one compatable wing nut.

5. The gate in claim 2 wherein means for joing, said short horizontal panels interposedly placed against said long horizonal panels' distal ends with a chosen set of said apertures coinciding are thus secured by fasteners to establish rigidity and width of said gate.

6. The gate in claim 1 wherein all said panels are made of galvanized steel of a predetermined gauge.

7. The gate in claim 1 wherein it can be further made of aluminum, plastic, or fiberglass.

* * * * *